US011369860B2

(12) United States Patent
Tyler

(10) Patent No.: US 11,369,860 B2
(45) Date of Patent: Jun. 28, 2022

(54) TRUCK ASSEMBLY AND WHEEL CONTROL STRUCTURES

(71) Applicant: Gerald Tyler, Santa Ana, CA (US)

(72) Inventor: Gerald Tyler, Santa Ana, CA (US)

( * ) Notice: Subject to any disclaimer, the term of this patent is extended or adjusted under 35 U.S.C. 154(b) by 16 days.

(21) Appl. No.: 16/998,399

(22) Filed: Aug. 20, 2020

(65) Prior Publication Data

US 2021/0052970 A1 Feb. 25, 2021

Related U.S. Application Data

(60) Provisional application No. 62/986,490, filed on Mar. 6, 2020, provisional application No. 62/889,980, filed on Aug. 21, 2019.

(51) Int. Cl.
*A63C 17/01* (2006.01)

(52) U.S. Cl.
CPC ..... *A63C 17/012* (2013.01)

(58) Field of Classification Search
CPC ..... A63C 17/012
See application file for complete search history.

(56) References Cited

U.S. PATENT DOCUMENTS

| | | | |
|---|---|---|---|
| 4,109,925 | A | 8/1978 | Williams et al. |
| 4,159,830 | A | 7/1979 | Solimine |
| 4,398,735 | A | 8/1983 | Evans et al. |
| 4,645,223 | A | 2/1987 | Grossman |
| 5,263,725 | A | 11/1993 | Gesmer et al. |
| 6,318,739 | B1 | 11/2001 | Fehn, Jr. |
| 6,474,666 | B1 | 11/2002 | Andersen et al. |
| 6,979,007 | B1 | 12/2005 | Hosoda |
| 7,080,845 | B2 | 7/2006 | Inchley |
| 7,150,460 | B2 | 12/2006 | Williams |
| 7,219,907 | B2 | 5/2007 | Chang |
| 7,243,925 | B2 | 7/2007 | Lukoszek |
| 7,635,136 | B2 | 12/2009 | Cole |
| 7,744,100 | B2 | 6/2010 | Cole |
| 8,186,694 | B2 | 5/2012 | Nelson et al. |
| 8,251,384 | B1 | 8/2012 | Christensen et al. |
| 8,424,882 | B2 | 4/2013 | Visinski et al. |
| 8,448,954 | B2 | 5/2013 | Wilson |
| 8,783,699 | B2 | 7/2014 | Gesmer |

(Continued)

FOREIGN PATENT DOCUMENTS

| | | |
|---|---|---|
| DE | 100 53 501 A1 | 5/2002 |
| TW | 201940211 | 10/2019 |

(Continued)

OTHER PUBLICATIONS

"Double Pivot Trucks." https://wackyboards.blogspot.com/2009/09/double-pivot.html, accessed Feb. 2019, please consider published before Feb. 21, 2018.

(Continued)

*Primary Examiner* — Brian L Swenson
(74) *Attorney, Agent, or Firm* — Knobbe, Martens, Olson & Bear, LLP

(57) ABSTRACT

A truck having configured to couple with a deck. The truck including a base and a hanger. The hanger disposed within a hanger aperture of the base. The hanger rotatably coupled with the base by a pivot assembly. The rotation of the hanger with respect to the base controlled by a compression assembly.

21 Claims, 19 Drawing Sheets

(56) References Cited

U.S. PATENT DOCUMENTS

| | | | | |
|---|---|---|---|---|
| 8,888,108 | B1* | 11/2014 | Beaty | A63C 17/0093 280/11.27 |
| 9,010,777 | B2 | 4/2015 | Braden et al. | |
| 9,095,765 | B2 | 8/2015 | Miller | |
| 9,144,730 | B1 | 9/2015 | Visinski et al. | |
| 9,145,030 | B2 | 9/2015 | Williams | |
| 9,199,158 | B2 | 12/2015 | Docter et al. | |
| 9,289,676 | B2 | 3/2016 | Docter et al. | |
| 9,295,902 | B2 | 3/2016 | Lininger, Jr. | |
| 9,821,215 | B2 | 11/2017 | Ivazes | |
| 9,950,244 | B1 | 4/2018 | Sargis | |
| 10,376,773 | B2 | 8/2019 | Chung et al. | |
| 10,391,384 | B2 | 8/2019 | Powell et al. | |
| 10,398,961 | B2 | 9/2019 | McGowan et al. | |
| 10,610,764 | B2 | 4/2020 | Tyler | |
| 10,967,244 | B2 | 4/2021 | Lininger, Jr. | |
| 11,117,043 | B2 | 9/2021 | Powell et al. | |
| 11,173,382 | B2 | 11/2021 | Augustin | |
| 2002/0125670 | A1* | 9/2002 | Stratton | A63C 17/01 280/87.041 |
| 2005/0167938 | A1 | 8/2005 | Chung et al. | |
| 2006/0006622 | A1* | 1/2006 | Gesmer | A63C 17/012 280/87.042 |
| 2006/0119062 | A1 | 6/2006 | Lukoszek | |
| 2008/0252026 | A1 | 10/2008 | Kang | |
| 2011/0089659 | A1 | 4/2011 | Hunt | |
| 2011/0210526 | A1* | 9/2011 | Williams, Jr. | A63C 17/0093 280/11.28 |
| 2013/0308887 | A1* | 11/2013 | Gesmer | B60B 27/0005 384/523 |
| 2015/0061252 | A1 | 3/2015 | Lininger, Jr. | |
| 2017/0203193 | A1* | 7/2017 | Powell | A63C 17/015 |
| 2019/0255423 | A1* | 8/2019 | Tyler | A63C 17/0093 |
| 2020/0222789 | A1 | 7/2020 | Tyler | |

FOREIGN PATENT DOCUMENTS

| | | |
|---|---|---|
| WO | WO 2014/133485 | 9/2014 |
| WO | WO 2017/186656 | 11/2017 |
| WO | WO 2019/164882 | 8/2019 |

OTHER PUBLICATIONS

International Search Report and Written Opinion in International application No. PCT/US2019/018687 dated Jun. 19, 2019, 14 pages.

International Preliminary Reporton Patentability in International application No. PCT/US2019/018687 dated Aug. 27, 2020, 10 pages.

* cited by examiner

TRUCK ASSEMBLY AND WHEEL CONTROL STRUCTURES

CROSS REFERENCE

Any and all applications for which a foreign or domestic priority claim is identified in the Application Data Sheet as filed with the present application are hereby incorporated by reference under 37 CFR 1.57.

BACKGROUND

Field

The inventions described herein generally relate to wheel support structures, for example, skateboard, longboard, scooter, and other wheeled support structure.

Related Art

Standard board designs (e.g., skateboard, longboard, or other vehicles) generally include a deck with two wheeled trucks bolted to the deck (e.g., front and rear). To steer the board, the user stands on the deck and leans left or right to actuate the two-wheeled trucks into a turn. A straight path can generally be maintained by keeping the deck level with the ground. Existing trucks include kingpin trucks, but these have various drawbacks. Accordingly there is a need for improved trucks.

SUMMARY

According to one aspect, a truck includes a base configured to couple with a deck and includes a hanger aperture. A hanger is within the hanger aperture of the base and pivotable about a pivot axis with respect to the base. A centering mechanism, includes a first plunger assembly coupled with a first mount portion of the base. A first plunger has a first end and a second end, the first end engaged with the hanger and a second end disposed within a housing of the first plunger assembly. In a first rotated position of the hanger relative to the base the first plunger exerts a first rotation opposing force on the hanger.

In another aspect, the hanger includes a stem including a distal end and a proximal end, the proximal end extending from the hanger. The distal end of the stem engages with the first end of the first plunger.

In another aspect, a second plunger assembly couples with a second mount portion of the base.

A second plunger includes a first end and a second end, with the first end engaged with the distal end of the stem and a second end disposed within a housing of the second plunger assembly. In a second rotated position of the hanger relative to the base, the second plunger exerts a second rotation opposing force on the stem. The first and second rotation opposing forces are configured to return the hanger into a centered position of the hanger relative to the base.

In another aspect, a spring disposed within the housing of the first plunger assembly biases the plunger into an extended position.

In another aspect, the spring includes a plurality of sections, each section having a different spring constant.

In another aspect, the spring includes a plurality of springs contained within the housing of the first plunger assembly.

In another aspect, the first rotation opposing force exerted by the first plunger against the stem is a function of an angle of rotation of the hanger relative to the base.

In another aspect, a rate of increase of the first rotation opposing force is greater below a specified angle of rotation of the hanger relative to the base than the rate of increase of the first rotation opposing force above the specified angle.

In another aspect, a rate of increase of the first rotation opposing force is greater above a specified angle of rotation of the hanger relative to the base than a rate of increase of the first rotation opposing force below the specified angle.

In another aspect, the first plunger assembly includes one of a damper and an inerter.

In another aspect, the housing of the first plunger assembly includes a first end portion having a threaded section and the first mount portion of the base includes a corresponding threaded section to assemble the housing with the base.

In another aspect, the stem is rigidly connected with the hanger.

In another aspect, the distal end of the stem includes an opposing surface on a first side configured to contact and engage with the first plunger through a range of rotation angles of the hanger relative to the base.

According to another aspect, a base couples with a deck. A hanger pivotably couples with the base.

The base exerts a torque on the hanger based on an angle of rotation of the hanger relative to the base. A resisting structure provides an adjustable resisting force on the hanger tending to bias the hanger back to a non-rotated position relative to the base.

In another aspect, a stem extends from the hanger.

In another aspect, the resisting structure is a plunger assembly on the base.

In another aspect, a rate of increase of the torque is greater below a specified angle than the rate of increase of the torque above the specified angle In another aspect, a rate of increase of the torque is greater above a specified angle than the rate of increase of the torque below the specified angle In another aspect, the torque is configured to center the hanger on the base.

In another aspect, the resisting structure is a plunger assembly including a plunger and a spring. The spring engages with the plunger to bias the plunger into an extended configuration. The spring couples with the base such that the plunger and the spring cause the torque on the hanger.

According to another aspect, a base couples with a deck and includes a hanger aperture. A hanger couples within the hanger aperture of the base and is pivotable about a pivot axis with respect to the base. A damping mechanism, includes a first cylinder coupled with a first mount portion of the base.

a first plunger having a first end and a second end, the first end engaged with the hanger and a second end disposed within the first cylinder. During rotation of the hanger relative to the base, the first plunger exerts a force on the hanger based on an angular velocity of the hanger.

According to another aspect, a truck for coupling with a deck includes an internal structure pivotably coupled with an external structure by a pivot assembly. The internal structure extends within a first opening of the external structure. A first pin assembly of the pivot assembly pivotably couples the internal structure with the external structure. A pin includes a shaft and a head. The shaft has a first aperture therethrough with the head received within and coupled with a second opening of the external structure. A damper insert has an engagement end and a brake section. The engagement end inserts within a first opening of the internal structure with brake section received within the first aperture of the shaft of the pin. The engagement end frictionally engages with the first opening of the internal structure and the brake section frictionally engages within the first aperture of the shaft of the pin such that rotation between the internal structure and the external structure about the pivot assembly is limited.

In another aspect, the damper insert includes a protrusion extending from the brake section opposite the engagement end, the protrusion disposed within a second aperture of shaft of the pin, the frictional engagement between the brake section and the shaft adjustable by a position of a movable set screw engaged with the protrusion and the second aperture of the shaft.

The foregoing summary is illustrative only and is not intended to be limiting. Other aspects, features, and advantages of the devices and/or other subject matter described in this application will become apparent in the teachings set forth below. The summary is provided to introduce a selection of some of the concepts of this disclosure. The summary is not intended to identify key or essential features of any subject matter described herein.

DETAILED DESCRIPTION

Figure 1:
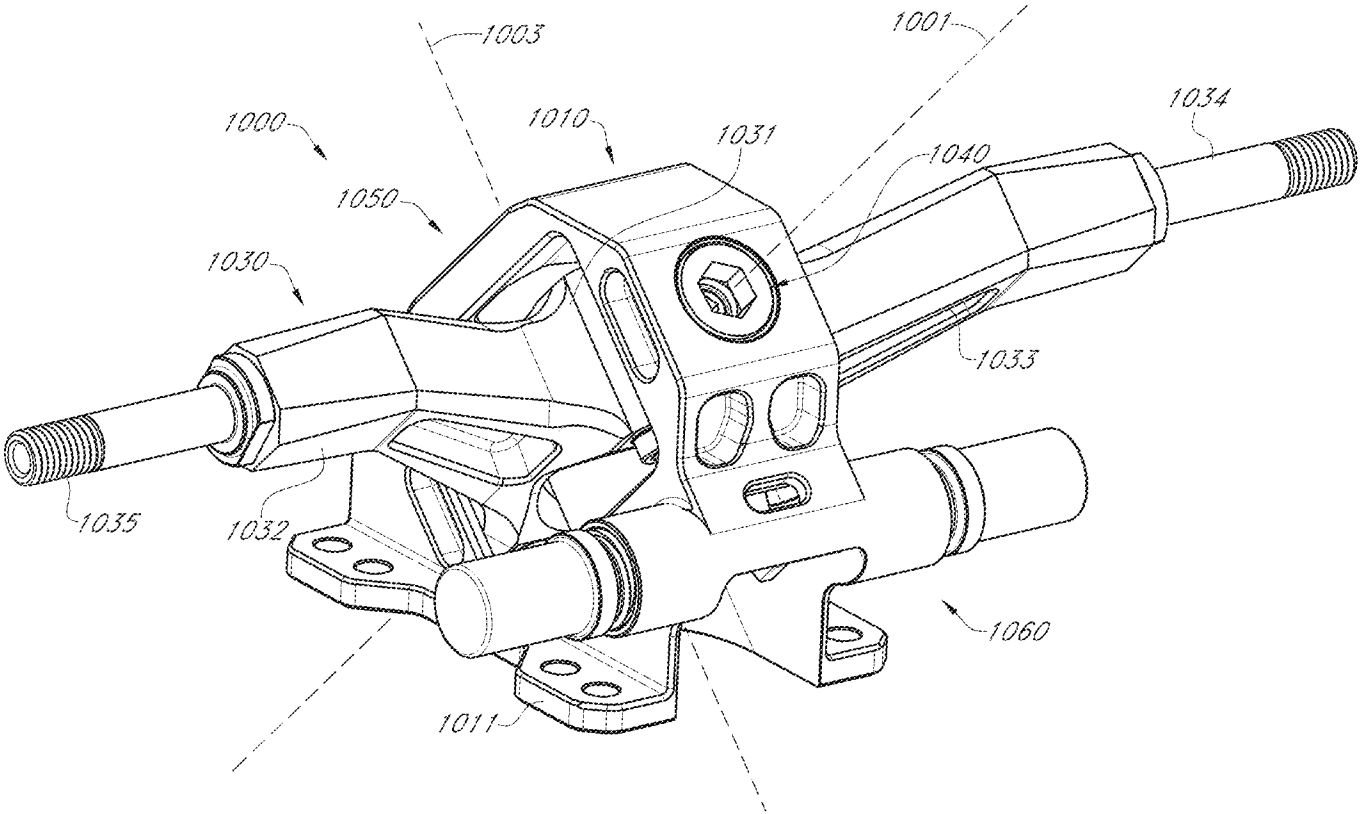
FIG. 1 illustrates a perspective view of a new embodiment of a truck.
Figure 2:
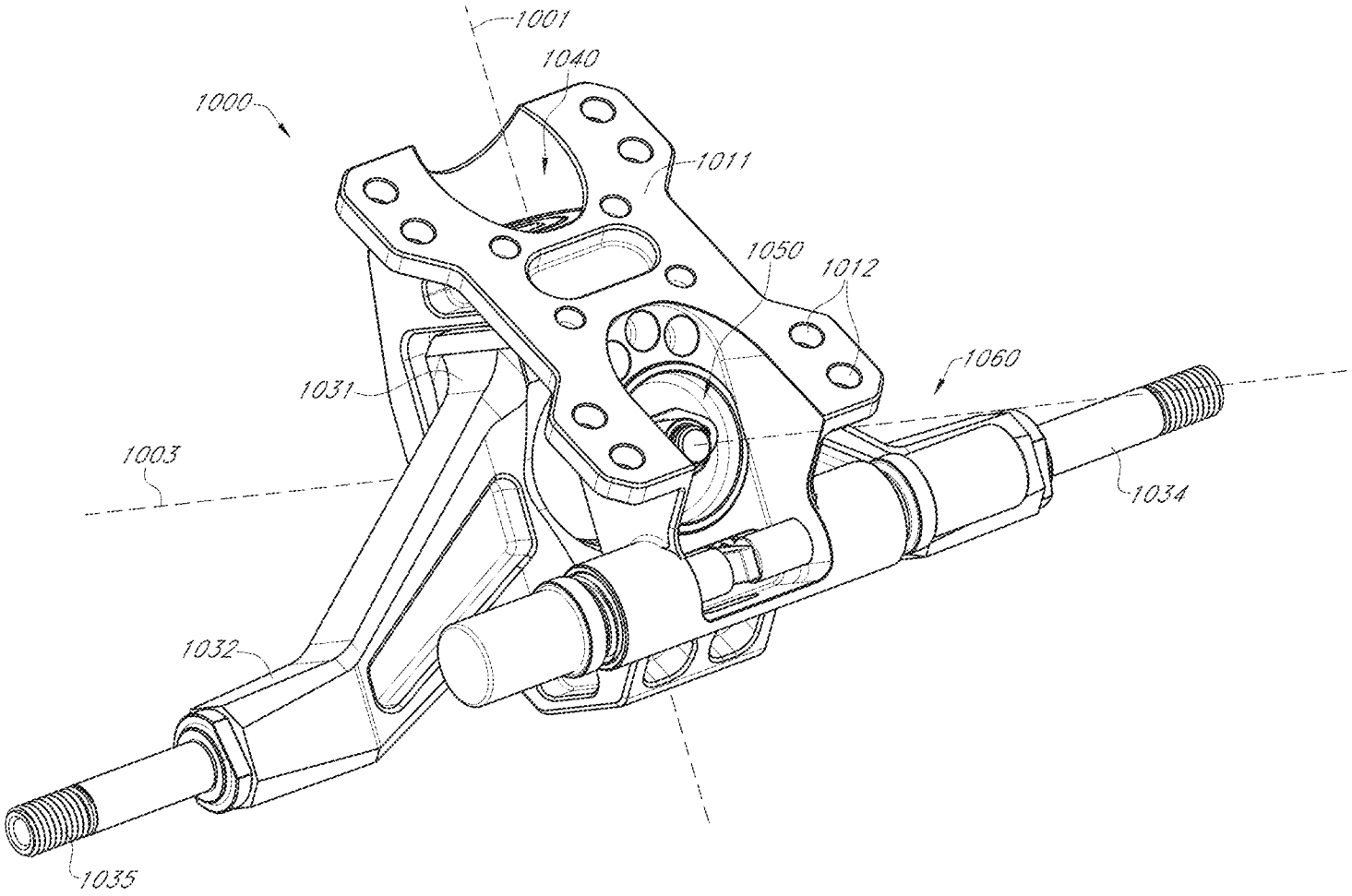
FIG. 2 illustrates a bottom perspective view of the truck of FIG. 1.

The various features and advantages of the systems and devices of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

Conventional board trucks are generally of the kingpin type (including the reverse kingpin and the standard kingpin). Kingpin-type trucks include a base and a hanger that rotates relative to the base at an angle. The hanger is coupled to the base at one end with a pivot cup. Another end of the hanger couples with a kingpin extending from the base. The coupling of the hanger with the kingpin is generally done through one or more bushings. Commonly, the bushings are made of a flexible material, such as urethane, making the connection between the hanger and the kingpin relatively unconstrained (e.g., the hanger can move radially, axially, and rotate with respect to the kingpin).

The effect of the kingpin/bushing support for the hanger allows for a great degree of "play" in the position of the hanger with respect to the base, including during its rotation. One sign of play is that the deck can be leaned with respect to the trucks without either or both of the trucks turning (e.g., without rotation of the hanger) and/or the trucks can turn without leaning the board. In certain applications, play (or excessive play) and/or the wobble created thereby is considered undesirable because it can be difficult for a user to control the board under various circumstances (e.g., riding downhill, encountering bumps, wobble at high speeds, etc.).

In the kingpin-type trucks, the weight of a user of the board is transferred from the deck and rests in part on the bushings. Thus, the weight of the user and the properties of the truck and bushings have an influence on the performance of the truck during use.

Accordingly there is a need for improved truck designs, certain aspects of which may address the problems with the existing truck designs. For example, one goal of certain embodiments described herein is to provide steering precision (e.g., kinematic control over rotation) and/or precision rotation between the hanger and the base. Another goal of certain embodiments is to separate suspension mechanisms from steering mechanisms. Another goal of certain embodiments is to eliminate the kingpin structure. Another goal of certain embodiments is to provide a truck structure that can include limiters to eliminate wheel bite.

Truck with Centering Mechanism

FIGS. 1-14 show another embodiment of a truck assembly having a base and hanger like the truck assemblies 100-900 disclosed in U.S. Pat. No. 10,610,764 (Tyler), the entirety of which is hereby incorporated by reference. The truck assembly 1000 can include a base 1010. The base 1010 can include a base plate 1011. The base plate 1011 is designed for connection with a board such as a skateboard, longboard or other deck structure. The truck 1000 can include a hanger 1030. The hanger 1030 can be pivotally coupled with the base 1010. The hanger 1030 can include a center portion 1031, a left wing 1032, a right wing 1033 and/or first and second wheel stems 1034, 1035. The hanger 1030 can be pivotally mounted with respect to the base 1010 along a pivot axis 1001. A pivot assembly 1040 can couple together the hanger 1030 with the base 1010 along the pivot axis 1001. The truck 1000 can include a compression axis 1003. The compression axis 1003 can extend through the base 1010 and/or the hanger 1030. A compression assembly 1050 can be assembled along the compression axis 1003. The compression assembly 1050 can at least partially control rotation of the hanger 1030 with respect to the base 1010 about the pivot axis 1001.

The truck 1000 can include a centering mechanism 1060. The centering mechanism 1060 can control and guide rotation of the hanger 1030 with respect to the base 1010 about the pivot axis 1001. The centering mechanism 1060 can include one or more plunger assemblies 1065, 1066 for interacting with the hanger 1030. The centering mechanism 1060 can overall be centered on the base 1010.

Figure 3:
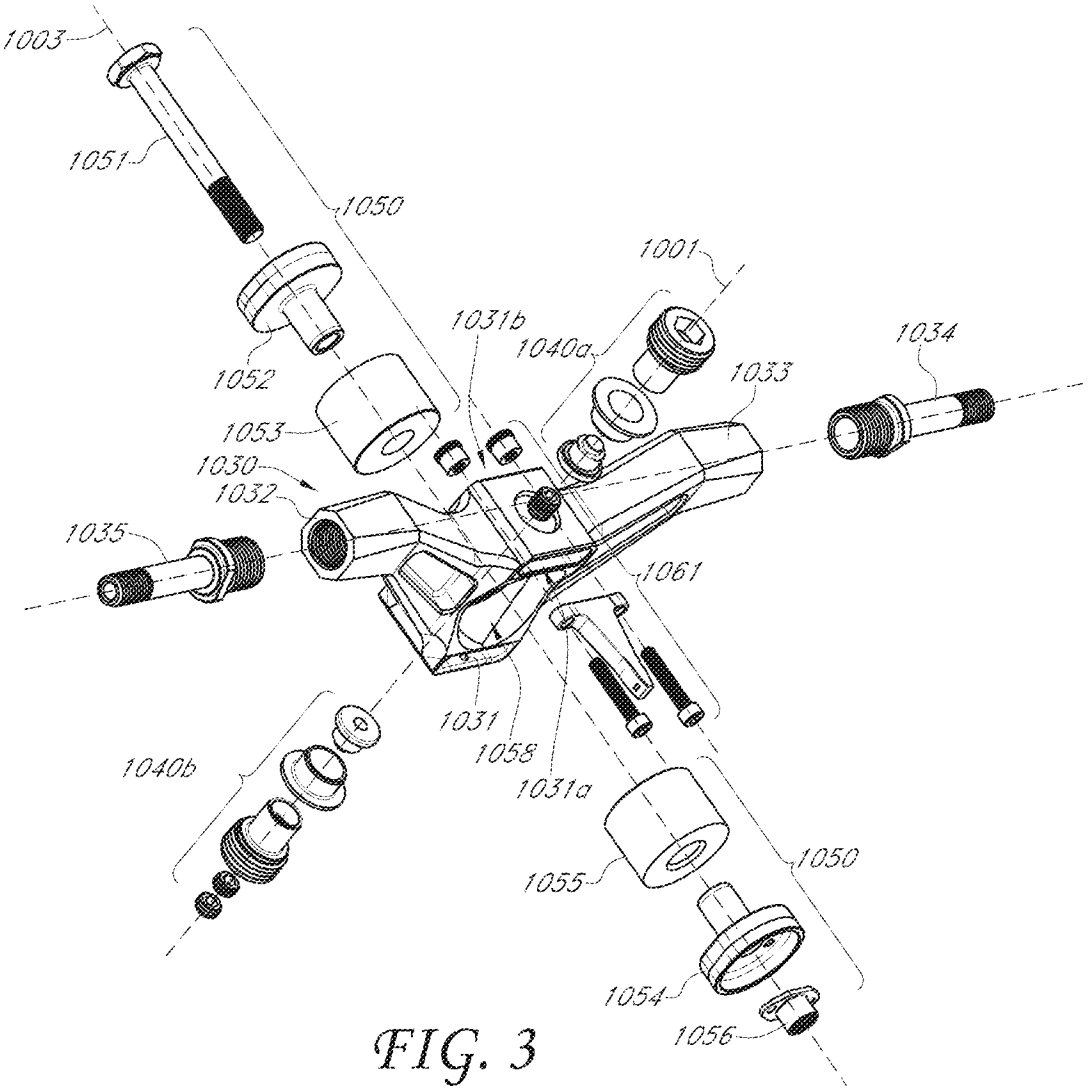
FIG. 3 shows an exploded view of a hanger of the truck of FIG. 1.

FIG. 3 shows an exploded view of the hanger 1030. The hanger 1030 can be assembled with the pivot assembly 1040. The pivot assembly 1040 can include a first pivot assembly 1040*a* and/or a second pivot assembly 1040*b*. The first and second pivot assemblies 1040*a*, 1040*b* can be aligned on opposite ends of the center portion 1031 of the hanger 1030. The first and second pivot assemblies 1040*a*, 1040*b* can be aligned along the pivot axis 1001.

The hanger 1030 can be assembled in conjunction with the compression assembly 1050. The compression assembly 1050, similar to the compression assemblies 50, 150, 250, etc. described in U.S. Pat. No. 10,610,764 can include a compression rod 1051, a first float bushing 1052, a bushing 1053, a second bushing 1055, a second float bushing 1054, and/or a nut 1056. The compression assembly 1050 can be aligned along the compression axis 1003. The second bushing 1055 can be received within an aperture 1058 or recess 1058 within the center portion 1031 of the hanger 1030. A corresponding recess 1059 (FIG. 12) opposite the first recess 1058 on the center portion 1031 can receive the first bushing 1053. Accordingly, the compression assembly 1050 can be adjusted to adjust and control rotation of the hanger 1030 with respect to the base 1010 (e.g., by tightening and loosening the compression pin 1051 and/or selection of the bushings 1053, 1055). In certain implementations, the centering mechanism 1060 can be used to control rotation of the hanger 1030 without the use of one or more components of the compression assembly (e.g., bushings 1053, 1055).

The hanger 1030 can be used in conjunction with a projection or stem assembly 1061. The stem assembly 1061 can be a subcomponent of the centering mechanism 1060. The stem assembly 1061 can be at least partially assembled within a recess 1031*a* and/or a second recess 1031*b* within the center portion 1031 of the hanger 1030.

Figure 4:
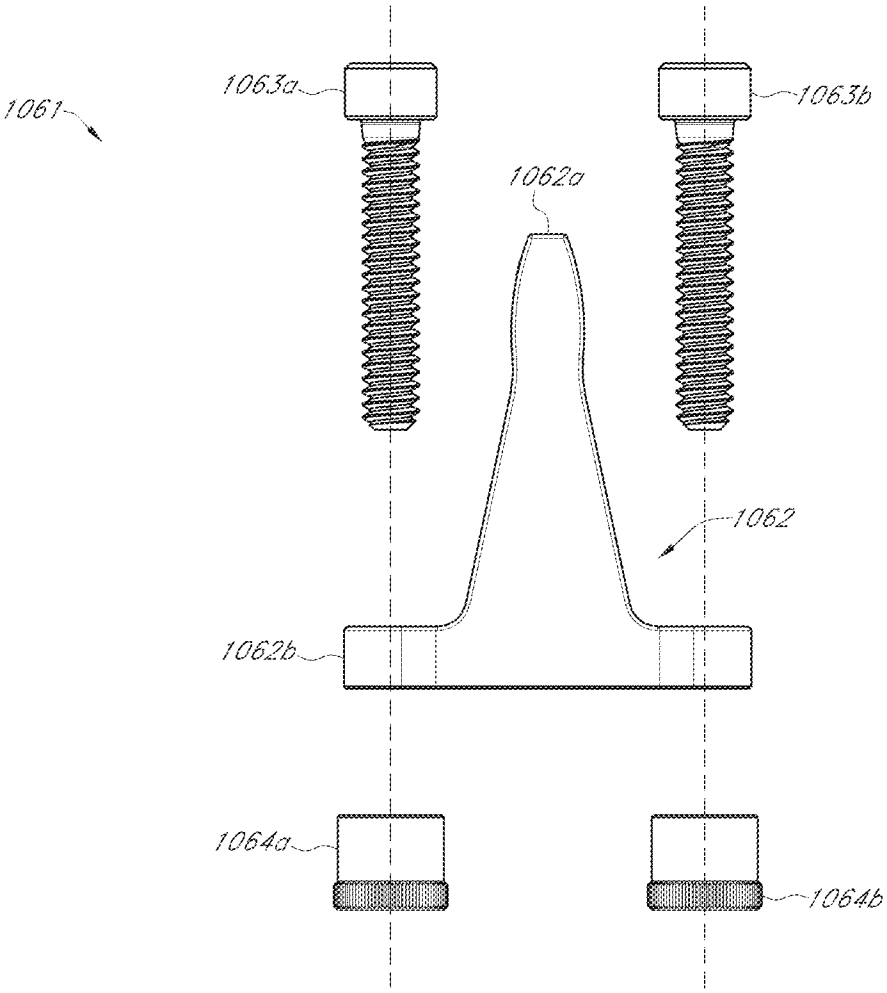
FIG. 4 shows a detailed view of a stem assembly.

FIG. 4 shows further detail of the stem assembly 1061. The stem assembly 1061 can include a stem 1062. The stem 1062 can include a proximal end 1062*b* and a distal end 1062*a*. The proximal end 1062*b* can include one or more apertures. The distal end 1062*a* can include a tip having opposite sides that include side curves. The stem assembly 1061 can include one or more mechanical fasteners for assembling the stem 1062 with the center portion 1031 of the hanger 1030. The stem assembly 1061 can include first and second bolts 1063*a*, 1063*b*. The first and second bolts can be received within apertures in the proximal portion 1062*b* of the stem 1062. The bolts 1063*a*, 1063*b* can engage with corresponding nuts 1064*a*, 1064*b*, respectively. In other implementations, the stem 1062 can include a rod or cylindrical projections.

Figure 5:
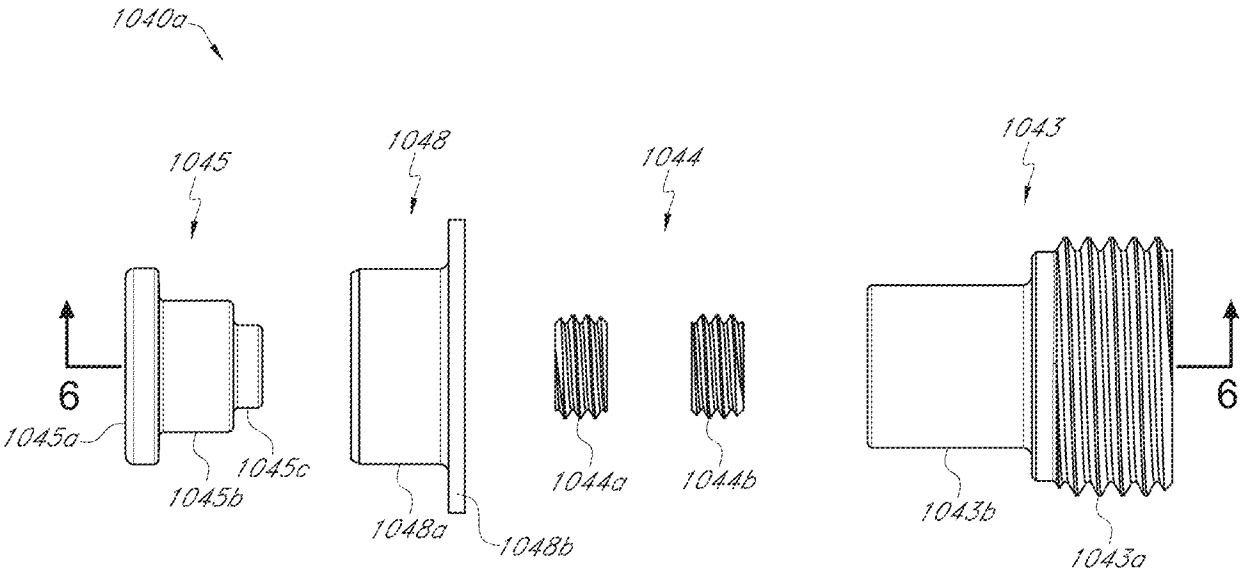
FIG. 5 shows a detailed view of a damper pin assembly.
Figure 6:
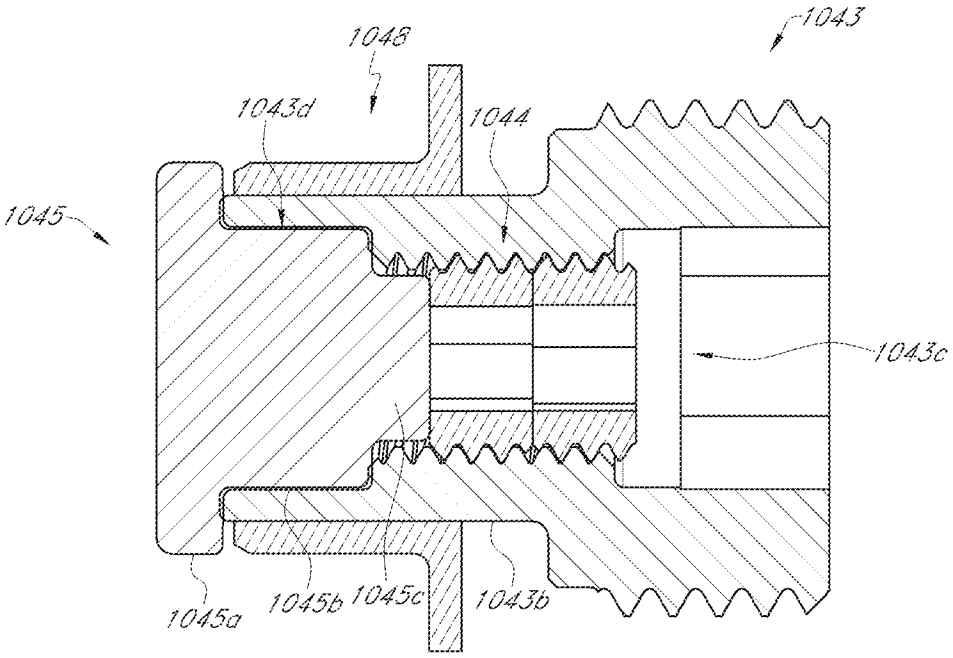
FIG. 6 shows a section view taken along the line 6-6 of FIG. 5 in an assembled state.

FIG. 5 shows a detailed exploded view of the first pin assembly 1040*a* of the pivot assembly 1040. The pin assembly 1040*a* can include a pin 1043. The pin 1043 can include a head or threaded end 1043*a*. The threaded end 1043*a* can include external threads thereon. The pin 1043 can include a shaft 1043*b*. The shaft 1043*b* can be cylindrical in shape. The shaft 1043*b* and/or the threaded end 1043*a* can include a central aperture 1043*c* therein as shown in FIG. 6.

The pin assembly 1040*a* can include a bushing 1048. The bushing 1048 can include a flange 1048*b* and/or a shaft portion 1048*a*. The bushing 1048 can be generally cylindrical in external shape and/or generally cylindrical in internal shape.

The pin assembly 1040*a* can include a damper insert 1045. The damper insert 1045 can be formed out of a unitary piece or multiple pieces of material. The material of the damper insert 1045 can include urethane, rubber, elastic, metal, glass, silicon, plastic or other polymer or any other suitable material. The damper insert 1045 can include an engagement end 1045*a*. The damper insert 1045 can include a brake portion 1045*b*. The damper insert 1045 can include an extension portion 1045*c*. The damper insert 1045 can be generally cylindrically shaped. Each of the sections of the damper insert 1045 can individually be cylindrically shaped and/or include a uniform diameter. The engagement end 1045*a* can have a larger diameter than the brake section 1045*b*. The brake section 1045*b* can have a larger diameter than the extension portion 1045*c*.

The pin 1043 can include a first internal shaft 1043*c*. The first internal shaft 1043*c* can have internal threads therein. The internal threads can be sized to receive the external threads of the socket set screws 1044. The first internal shaft 1043*c* can be sized to receive the extension portion 1045*c* of the damper insert 1045. The pin 1043 can include a second internal shaft 1043*d*. The second internal shaft 1043*d* can be within the shaft portion 1043*b*. The second shaft 1043*d* can be sized to receive the brake portion 1045*b* of the damper insert 1045.

When assembled within the truck 1000, adjustment of the damper insert 1045 can adjust the pivoting of the hanger 1030 with respect to the base 1010 along the pivot axis 1001. The amount of grip between the brake portion 1045*b* and the second internal shaft 1043*d* and/or the shaft 1043*b* with the brake engagement end 1045*a* can influence the amount of friction during rotation of the hanger 1030 along the pivot axis 1001. The engagement of the engagement end 1045*a* with the hanger 1030 and particularly with the center portion 1031 can be adjusted by engagement of one or more set screws 1044 within the first internal shaft 1043*c* by applying more or less pressure to the brake portion 1045*b* the amount of engagement between the shaft 1043*b* and the damper insert 1045 can be adjusted. This can add or lessen pressure on the extension portion 1045*c* and used to expand or relax an outer diameter of the brake portion 1045*b* held within the second internal shaft 1043*d*. In an alternative arrangement, the damper insert 1045 can include a spring-loaded pin.

Figure 7:
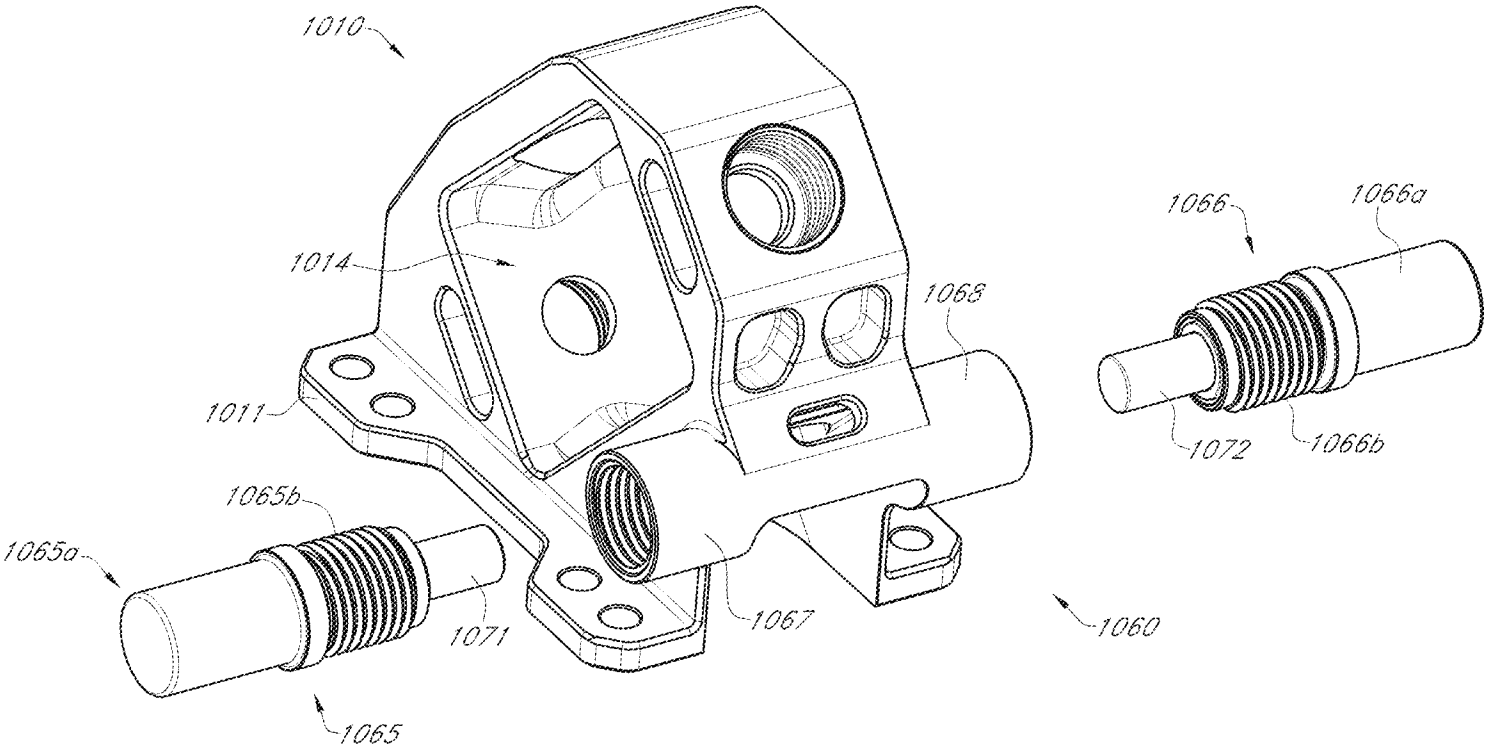
FIG. 7 is a partial exploded view of a centering mechanism.
Figure 8:
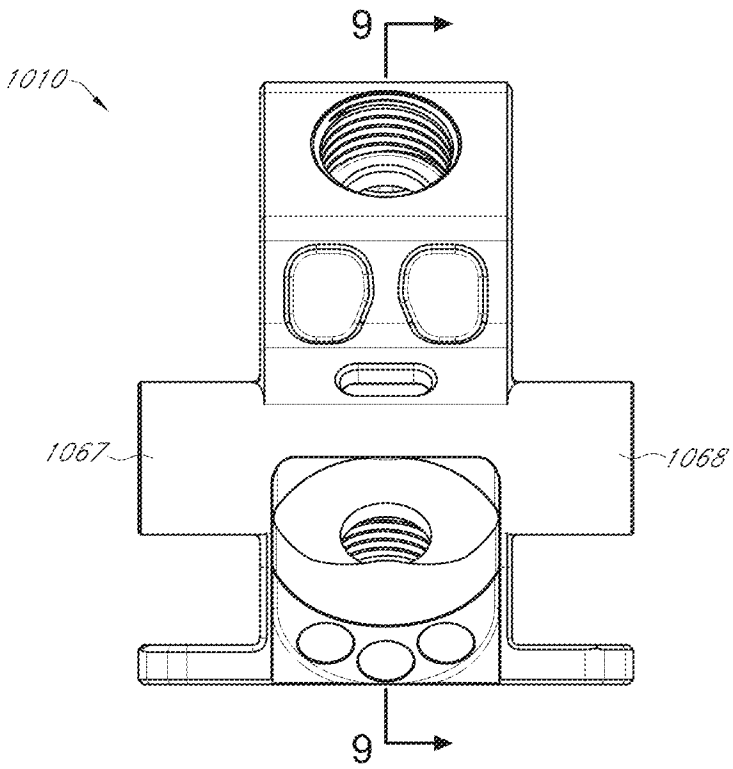
FIG. 8 is a front view of a base of the truck assembly of FIG. 1.

FIG. 7 shows a partial exploded view of the base 110. The base 110 can include a central aperture 1014. The central aperture 1014 can be sized to receive the hanger 1030. The base 1010 can include components of the centering mechanism 1060. The base 1010 can include a first mounting portion 1067 and/or a second mounting portion 1068. The first mounting portion 1067 can include a generally cylindrical outer shape. The first mounting portion 1067 can include an inner aperture. The inner aperture can include a threaded region. The second mounting portion 1068 can have a similar structure as the first mounting portion 1067.

The centering mechanism 1060 can include a first plunger assembly 1065. The first plunger assembly 1065 can include a housing 1065*a*. The housing 1065*a* can include a plunger 1071. The plunger 1071 can be moveable within the housing 1065*a*. The housing 1065*a* can include a threaded portion 1065*b*. The threaded portion 1065*b* can include threads that engage with the internal threads of the mounting portion 1067 on the base 1010. Accordingly, the plunger assembly 1065 can be mounted with the base 1010. In certain implementations, the engagement position of the threaded portion 1065*b* with the mounting portion 1067 can be adjustable (e.g., by more or less engagement of the threaded portions). Accordingly, the force exerted by the plunger 1071 can be adjustable to pre-compress or pre-relax the spring 1075 before riding with the truck 1000.

The centering mechanism 1060 can include a second plunger assembly 1066. The second plunger assembly 1066 can include a housing 1066*a*, a threaded portion 1066*b*, a plunger 1072, be engageable with the second mounting portion 1068 on the base 1010, a spring 1077 and/or a bushing 1074. The second plunger assembly 1066 can have the same or similar structures as the first plunger assembly 1065 and function in the same or similar manner.

Figure 9:
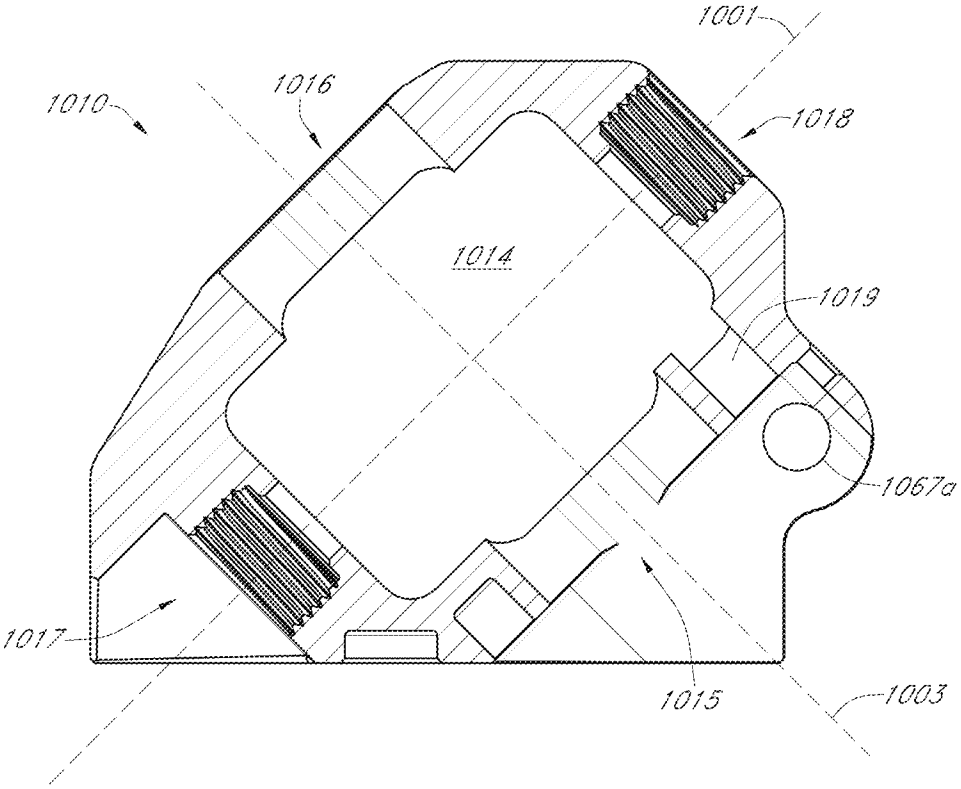
FIG. 9 is a section view taken along the line 9-9 in FIG. 8.

FIG. 9 shows a section view of the base 1010 taken along the line 71-71. The base 1010 can include the central aperture 1014 for receiving the hanger 1030. The base 1010 can include a first aperture 1015 and a second aperture 1016 for receiving components of the compression assembly 1050. The first and second apertures 1015, 1016 can be aligned along the compression axis 1003.

The base 1010 can include a third aperture 1017 and a fourth aperture 1018. The third and fourth apertures 1017, 1018 can be used in conjunction with the pivot pin assemblies 1040*a*, 1040*b* for pivotally mounting the hanger 1030 with respect to the base 1010. The third and fourth apertures 1017, 1018 can be aligned along the pivot axis 1001. The third and fourth apertures 1017, 1018 can each include internal threads for engaging with the external threads of the pins 1043 of the first and second pin assemblies 1040*a*, 1040*b*.

The base 1010 can include a through slot 1019. The through slot 1019 can extend from the central aperture 1014 through an outer wall of the base 1010. The through aperture 1019 can be sized to receive the stem 1062 of the stem assembly 1061.

The base 1010 can include one or more apertures in the first and second mounting portions 1067, 1068. Apertures 1067*a* and 1068*a* (not shown) can be sized to receive the respective plungers 1071, 1072.

Figure 10:
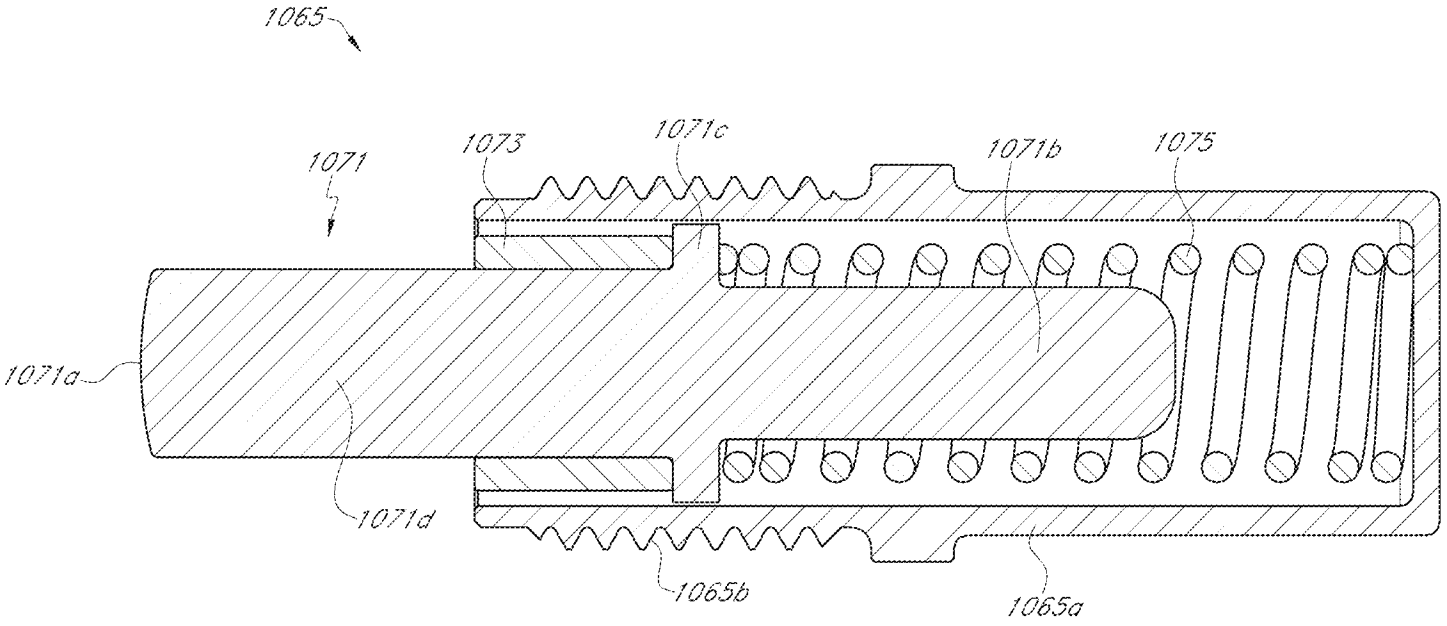
FIG. 10 is a section view of a plunger assembly.

FIG. 10 shows a section view of the first plunger assembly 1065. The first plunger assembly 1065 can include the housing 1065*a*. The housing 1065*a* can include the outer threaded region 1065*b*. The plunger 1071 can be at least partially disposed within the housing 1065*a*. The plunger assembly 1065 can include a bushing 1073. Bushing 1073 can be compressible in a spring-like manner (e.g., formed of a rubber or urethane or other material). Alternatively, bushing 1073 can be a wire spring.

The plunger 1071 can include a first end 1071*a*. The first end 1071*a* can extend out of the housing 1065*a*. The plunger 1071 can include an internal shaft 1071*b*. The internal shaft 1071*b* can be at the opposite end of the first end 1071*a*. The plunger 1071 can include a flange 1071*c*. The flange 1071*c* can be located between the shaft 1071*b* and the first end 1071*a*. The plunger 1071 can include an external shaft 1071*d*. The external shaft 1071*d* can include the first end 1071*a*. The external shaft 1071*d* can be separated from the internal shaft 1071*b* by the flange 1071*c*. The external shaft 1071*d* can be stabilized within the housing 1065*a* by the bushing 1073. The plunger 1071 can be slideable within the bushing 1073 and the housing 1065*a*. The plunger 1071 can be generally cylindrical in shape. Accordingly, the flange 1071*c* can have a generally cylindrical shape.

The plunger assembly 1065 can include a spring 1075. The spring 1075 can be located within the housing 1065*a*. One end of the spring 1075 can be received over the shaft 1071*b* of the plunger 1071. The second end can be abutted against an end of the housing 1065*a*. The spring 1075 can bias the plunger 1071 into an extended position to extend from the shaft housing 1065*a*. Alternatively, the spring 1075 can be a bushing (e.g., urethane or rubber bushing).

The spring 1075 can compress when a force is applied to the plunger 1071 and shift the plunger 1071 further within the housing 1065*a*. The compression distance can be governed according to the spring constant and the amount of force applied to the plunger 1071 (e.g., through Hooke's law). The spring 1075 can exert a force based on the compression length of the spring 1075 by the plunger 1071. The spring 1075 can pre-compress the plunger 1071 against the bushing 1073.

Figure 11:
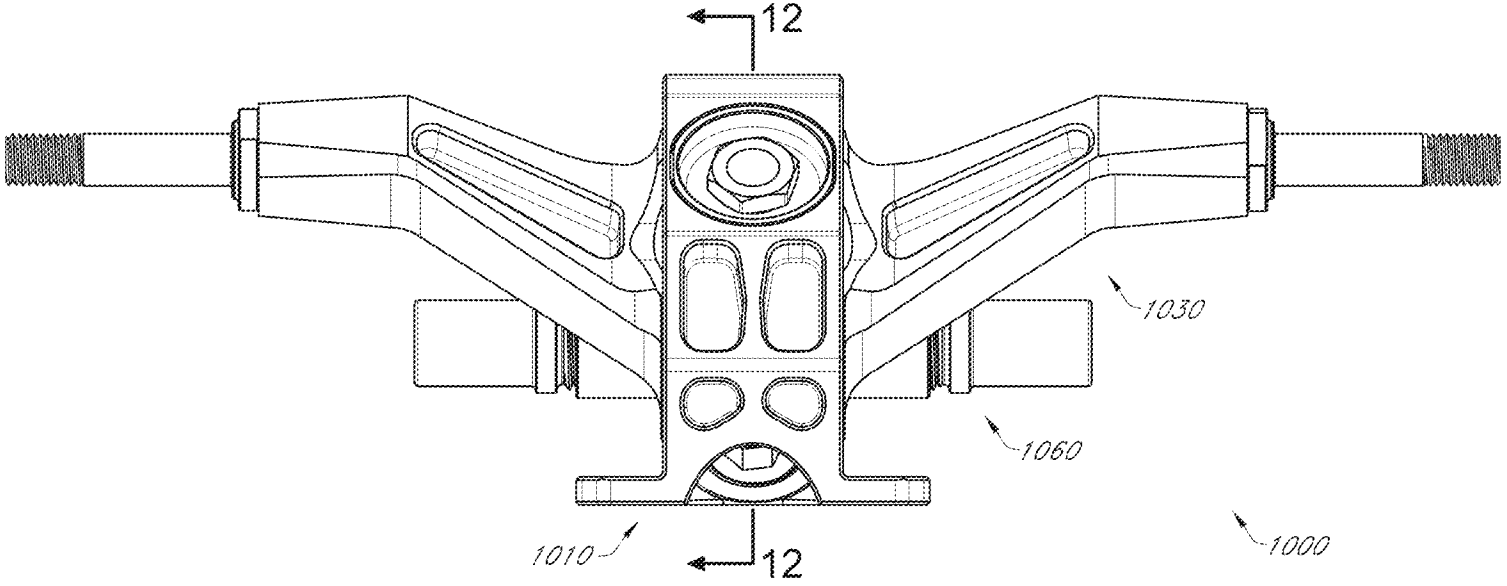
FIG. 11 shows a front view of the truck assembly of FIG. 1.
Figure 12:
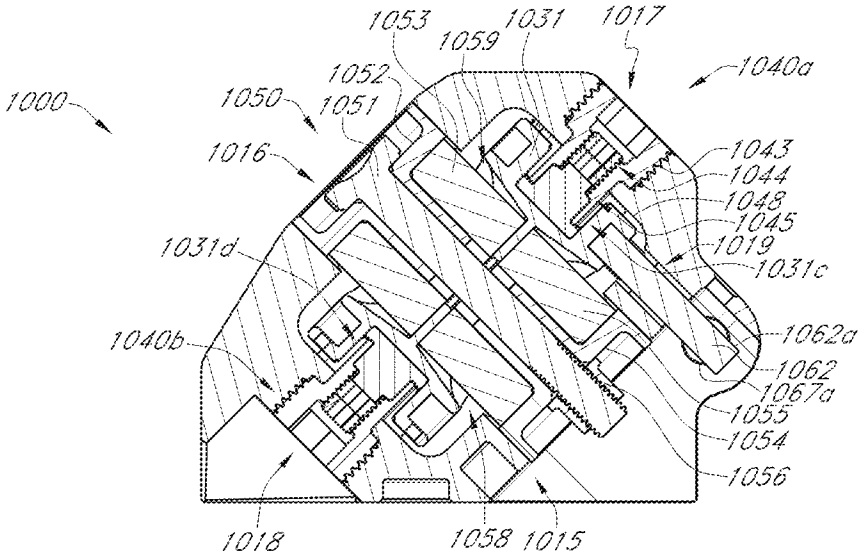
FIG. 12 is a section view taken along the line 12-12 in FIG. 11.

FIGS. 11-12 shows an assembly of the truck 1000. The compression assembly 1050 can be assembled around the hanger 1030. Specifically, the first and second bushing 1053, 1055 can be received within the apertures 1059, 1058 of the hanger 1030, respectively. The float bushings 1052 can be received within or in contact within the bushing 1053. The float bushing 1054 can be received within or in contact with the second bushing 1055. The compression shaft 1051 can be received within the floating bushings 1052, 1054, an aperture of the hanger, and/or apertures of the first and second bushings 1053, 1055. The nut 1056 can be assembled with the compression shaft 1051. The nut 1056 can be used to adjust a tightness of the compression assembly 1050 which corresponds to more or less resistance to rotation for the hanger with respect to the base 1010 about the pivot axis 1001. The floating bushings 1052, 1055 can be received within the first and second apertures 1015, 1016, respectively.

The pivot assembly 1040 can be assembled between the base 1010 and the hanger 1030. The first pivot assembly 1040*a* can be at least partially assembled within the third aperture 1017. The pin 1043 can be received within and engaged with internal threads of the third aperture 1017. The damping insert 1045 can be received within a third aperture 1031*c* of the center portion 1031 of the hanger 1030. The brake portion 1045*b* can be received within the shaft 1043*b* of the pin 1043 (e.g., internal shaft 1043*d*). The bushing 1048 can be received at least partially within the third aperture 1031*c*. The shaft 1044*b* can be received at least partially within the bushing 1048. The set screws 1044 can be received within the first shaft portion 1043*c* of the pin 1043. The set screws 1044 can be adjustable to adjust rotation of the damper insert 1045 with respect to the pin 1043. Similarly, the second pin assembly 1040*b* can be assembled within the fourth aperture 1018 of the base 1010 and a fourth aperture 1031*d* of the center portion 1031 of the hanger 1030.

The stem 1062 can be assembled with the hanger 1030. The stem 1062 can be assembled with the center portion 1031. The proximal end 1062*b* can be received within the recess 1031*a* of the center portion 1031. The first and second bolts 1063*a*, 1063*b* can be received within the slots of the proximal end 1062*b* and pass through internal portions of the center portion 1031 and engage with the respective nuts 1064*a*, 1065*b*. Accordingly, the stem 1062 can be rigidly engaged with the hanger 1030. The stem 1062 can be received within the aperture 1031*a*. The stem 1062 can pass through the slot 1019. The distal end 1062*a* of the stem 1062 can be generally aligned with the apertures 1067*a*, 1068*a* (not shown). Alternatively, the stem 1062 can be formed integrally with the hanger 1030.

Figure 13:
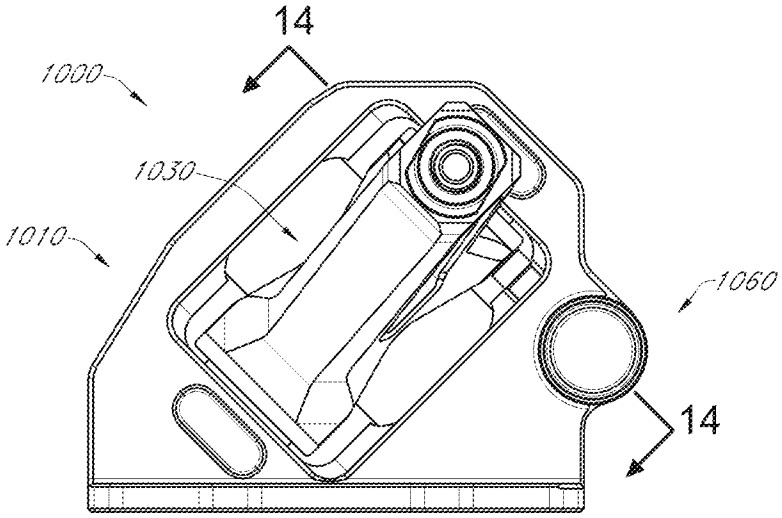
FIG. 13 is a side view of the truck assembly of FIG. 1.
Figure 14:
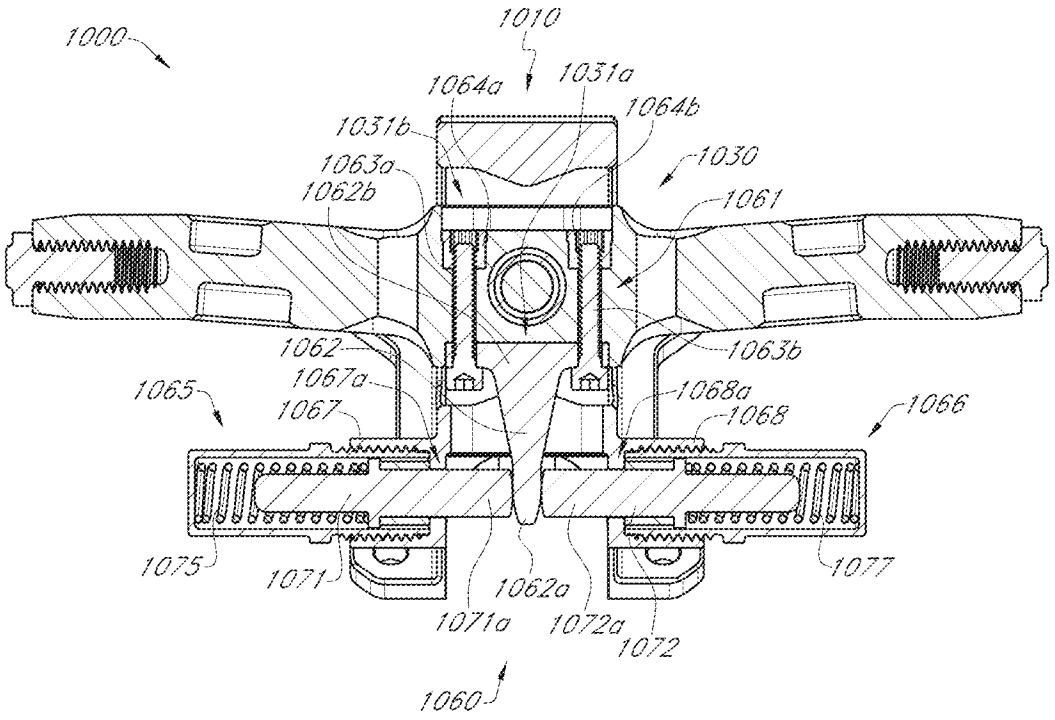
FIG. 14 is a section view taken along the line 14-14 in FIG. 13.

FIGS. 13-14 shows the assembly of the centering mechanism 1060. The first plunger assembly 1065 can be assembled with the first mount portion 1067 of the base 1010. The second plunger assembly 1066 can be assembled with the second mount portion 1068 of the base 1010. The first plunger 1071 can be received through the aperture 1067*a*. The second plunger 1072 can be received through the second aperture 1068*a*. The ends 1071*a*, 1072*a* of the first and second plunger 1071, 1072 can engage with the curved surface of the stem 1062. The stem 1062 can include the distal end 1062*a* that can engage with the ends 1071*a*, 1072*a*. Curves of the distal end 1062*a* can enhance engagement and provide constant contact between the distal end 1062*a* in either the ends 1071*a* or 1072*a* when the hanger 1030 is rotated about the pivot axis 1001.

Rotation of the hanger about the pivot axis will cause translation of the stem 1062 that translation the first or second plungers 1071, 1072, depending on the direction of the turn. The spring 1075 can provide a resistance force to translation of the plunger 1071. When there is sufficient torque about the hanger 1030, the resultant force can overcome the force provided by the spring 1075. As the spring 1075 is compressed by the force from the stem 1062 the spring can apply a force that is equal and opposite to the torque being applied through the stem 1062. The spring 1075 can apply a force through the plunger 1071. The second plunger assembly 1066 can operate in a similar manner when the hanger 1030 is rotated in the opposite direction. Accordingly, the plunger assemblies 1065, 1066 can be used together to center the stem 1062. Accordingly, the hanger 1030 can be centered with respect to the first and second plunger assemblies 1065, 1066. Accordingly, the centering mechanism 1060 can center or bias the hanger 1030 into a centered configuration. The plunger assemblies 1065, 1066 can apply a force to the hanger 1030 when the hanger 1030 is in a tilted configuration about the pivot axis 1001. In an alternative variation, one or both of the plungers 1071, 1072 can be coupled with the stem 1062 in the manner of a scotch-yoke mechanism. In another arrangement, various different plungers can be coupled with the stem 1062 on each side thereof. Each plunger or corresponding pairs of plungers can provide a different reaction force, dampening, or inerter force against the stem 1062. Optionally, the bushings 1053, 1055 can be unnecessary to control the rotation of the hanger 1030. Instead, the rotation of the hanger 1030 can be controlled entirely by the plungers 1071, 1072 and/or other plungers or other stems.

Rotation of the hanger 1030 about the pivot axis 1001 can variously be limited by the internal structure of the central aperture 1014, the maximum displacement lengths of the plungers 1071 and/or 1072, the damping inserts of the first and/or second pin assemblies 1040*a*, 1040*b*, one or more limiters on the central portion 1031 or elsewhere on the hanger 1030, engagement of wheels with the deck to which the truck 1000 is attached, and/or use the compression assembly 1050. Accordingly, the torque-response of the hanger 1030 moving about the base 1010 can be customized to provide a desirable response profile for a particular user by modifying any of these variables.

The forces applied by either or both of the plunger assemblies 1065, 1066 and the resultant torque on the hanger 1030 can be adjusted by changing the springs 1075, 1077 and/or the bushings 1073, 1074. Taking plunger assembly 1065 as an example, the spring 1075 can have a single spring constant value. A single spring constant can result in a linear torque-angle curve exerted by each of the plunger assembly 1065. Accordingly, the torque response profile of the hanger 1030 per angle of rotation with respect to the base 1010 can be adjustable by changing spring 1075.

Figure 15:
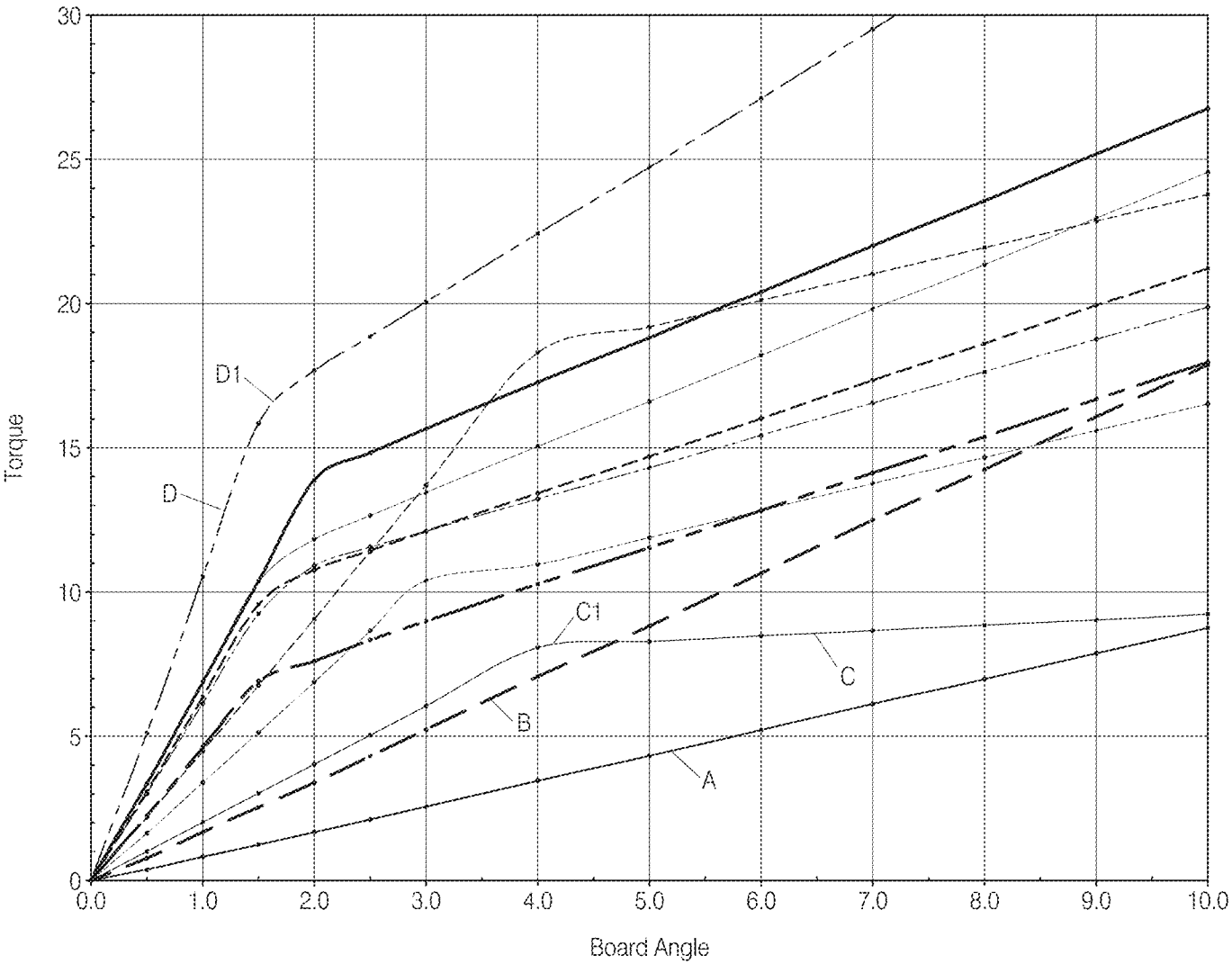
FIG. 15 shows torque-response curves for the centering mechanism.
Figure 19:
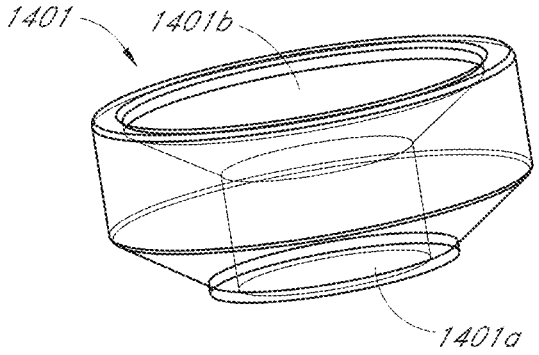
FIG. 19 shows a disc spring.
Figure 20:
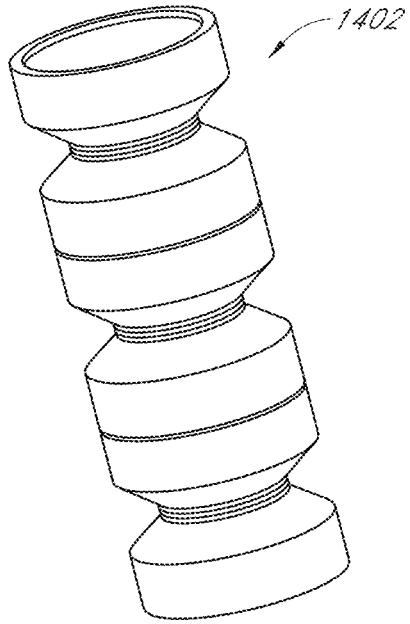
FIG. 20 shows a stack of disc springs.
Figure 21:
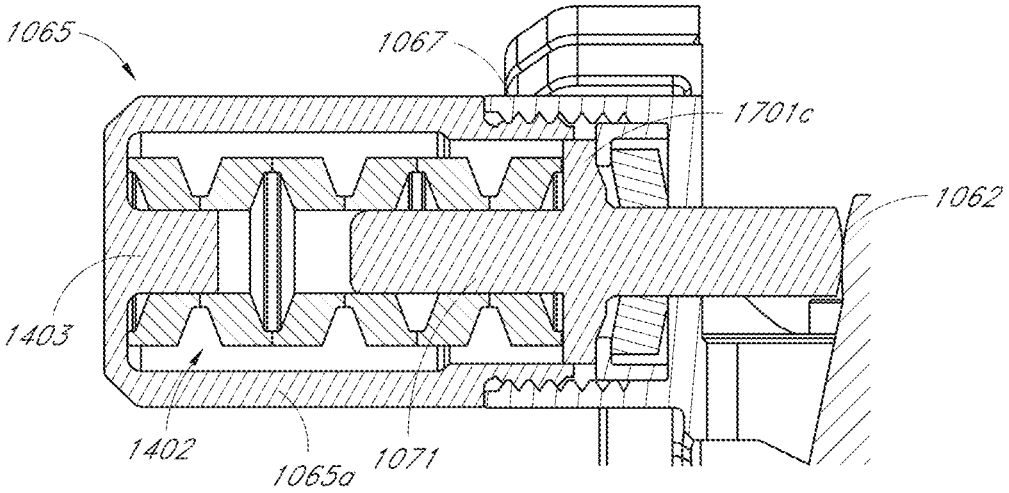
FIG. 21 shows a section view of a plunger including a stack of disc springs.

In other implementations, the spring 1075 can have multiple different portions having different spring constant values. As shown in FIG. 15, a torque-angle responses can have multiple different linear (e.g., increasing) responses. Accordingly, the spring 1075 and/or bushing 1073 can provide greater or lesser amounts of force per unit of compression depending on the portion of the spring compressed. In other implementations, the spring 1075 can have multiple different springs (e.g., within the housing 1065*a*) having different spring constant values. In other implementations, other materials can be included within the housing 1065*a* to change the spring constant. The spring 1075 can comprise one or more disc springs 1401, as shown in FIGS. 19-21. The disc springs 1401 can comprise a urethane material. A first end 1401*a* of the disc springs can be convex. A second, opposite, end 1401*b* of the disc springs can be concave. One or more of the disc springs 1401 can be arranged in stacks 1402 in series (first end stacked against first end or second end stacked against second end) and/or parallel (first end stacked against second end) to provide the desired spring constant values. As shown in FIG. 21, the disc springs 1401 can be compressed (e.g. in the stack 1402) to fill the available space (e.g., within the housing 1065*a*). The stacked disc springs 1402 can be assembled on the plunger 1071, in lieu of, or in addition to one or more springs 1075. Optionally, the housing 1065*a* includes an alignment shaft 1403 for aligning within one or more of the discs 1401 in the stack 1402.

Alternatively, the centering mechanism 1060 can be a band system (not shown). The band system can comprise a plurality of rubber bands engaged with the stem 1062 to bias the hanger 1030 to center. Alternatively, the centering mechanism 1060 can include one or more bow spring. The bow spring can be positioned between the stem 1062 and the base (e.g., at the mount portions 1067, 1068) to center the hanger 1030.

As shown in FIG. 15, the selection of springs (e.g., spring 1075 and/or bushing 1073) can create different torque-angle functions for the hanger 1030 (in one rotation direction; a corresponding graph can apply to the opposite rotation direction). Function A shows a linear response from the compression assembly 1050. The slope of function A can be adjusted by use of stiffer or softer bushings 1053, 1055.

In certain implementations, the amount of preloading on the bushings 1053, 1055 (e.g., by tightening or loosening the compression assembly 1050) can be adjusted. The preloading introduce an elbow (not shown) in Function A. The elbow can separate a first segment having a higher slope from a second segment having a lower slope.

Function B shows a linear response from a single spring (e.g. 1075) in the plunger assembly 1065 (without input from the compression assembly 1050). The angle of rotation can be directly related to the position of the plunger 1071 in the assembly 1065. The slope of Function B can be adjusted by use of a stiffer or softer spring 1075. The y-intercept of the Function B can be adjusted by preloading the plunger assembly 1065. For example, the plunger 1071 can be depressed at the 0 degree rotation mark for the hanger 1030 (e.g., centered on the base 1010).

Function C shows a torque response of the plunger assembly 1065 having both the bushing 1073 and the spring 1075. The spring 1075 can pre-load the bushing 1073. Function C can include two linear segments that meet approximately at an elbow C1. Accordingly, for a first travel segment (before the elbow C1), the plunger 1071 acts against the combined spring constants of bushing 1073 and spring 1075. For a second travel segment (after the elbow C1), the plunger 1071 acts against the spring constant of spring 1075. The plunger 1071 no longer acts to compress the bushing 1073. Accordingly, the slope of Function C can be higher before than elbow C1 than after the elbow C1. Advantageously, the higher slope of Function C approximate angle θ (e.g., centered position of hanger 1030) and before the elbow C1 can assist a user in maintaining a straight course. Advantageously, the lower slope of Function C after the elbow C1 can allow a user to easily steer. In certain implementations, the plunger 1065 can include a third spring. The third spring can be located in the bottom of the housing 1065*a* (e.g., within a pocket). The end of the internal shaft 1071*b* can depress the third spring when the plunger 1071 is moved into contact therewith (e.g., during a third travel segment of the plunger after the first and second elbows). This interaction with the third spring (with or without the spring 1075) can create another elbow in the Function C (not shown). After the second elbow, the slope of Function C can be linear, but at an increased slope. In certain implementations, this configuration can be used to prevent over rotation of the hanger (e.g., to prevent wheelbite). Any number of additional springs can be included to add more elbows to the curve.

In certain implementations, the torque response can also include a second elbow (not shown) before the first elbow C1. The second plunger assembly 1066 can pre-load the first plunger assembly 1065 on the opposite side of the stem 1062. Accordingly, for a third travel segment (before the second), the plunger 1071 acts against the combined spring constants of bushing 1073, spring 1075, and pre-loading from the second plunger assembly 1066. The third segment of Function C can be before the second elbow (and before the first segment and the first elbow C1) and have a steeper slope than the first segment. In certain other implementations, the spring 1075 can include multiple different segments having different spring constants.

Function D, and the remaining functions show possible torque responses for various combinations of the Functions A and C with selected spring constants for the bushings 1053, 1055, bushing 1073, spring 1075 and/or preloading by the second plunger assembly 1066.

Although the above functions are described as including linear segments, the linearity of the segments can be approximate. Moreover, the elbows can be a "soft" elbows representing a gradual change in slope between approximately linear travel segments. The torque response of the first or second plunger assemblies 1065, 1066 can be zero at the centered position of the hanger 1030 (angle 0°). As shown in FIG. 15, each of the Functions A-D is exerts zero torque in the center position. The torque response of the first or second plunger assemblies 1065, 1066 can alternatively be nonzero at the centered position of the hanger 1030 (angle 0°). The torque response can be adjusted for any of the functions by preloading. Preloading can include compression of the spring(s) contained within the housing 1065*a* and/or the inclusion of overly long springs for the housing 1065, or additional springs. The effect of the preloading can be to shift the torque functions to the left (raising the y-intercept) for a given spring system. If a torque (e.g., a preloading torque) is the same for plungers 1071 and 1072, this would be represented with a symmetrical plot having a central V-shaped feature at x=0 and mirroring the curve about the Y-axis in FIG. 15. Pre-loading the torque symmetrically may tend to reduce the depth of the V, relative to a non-preloaded system. Any of the Functions A-D can be adjusted (e.g., by preloading) to be greater than 0 at angle 0° (at x=0, or the y-intercept). This arrangement can increase the torque required to move the hanger 1030 out of the center position.

Figure 16:
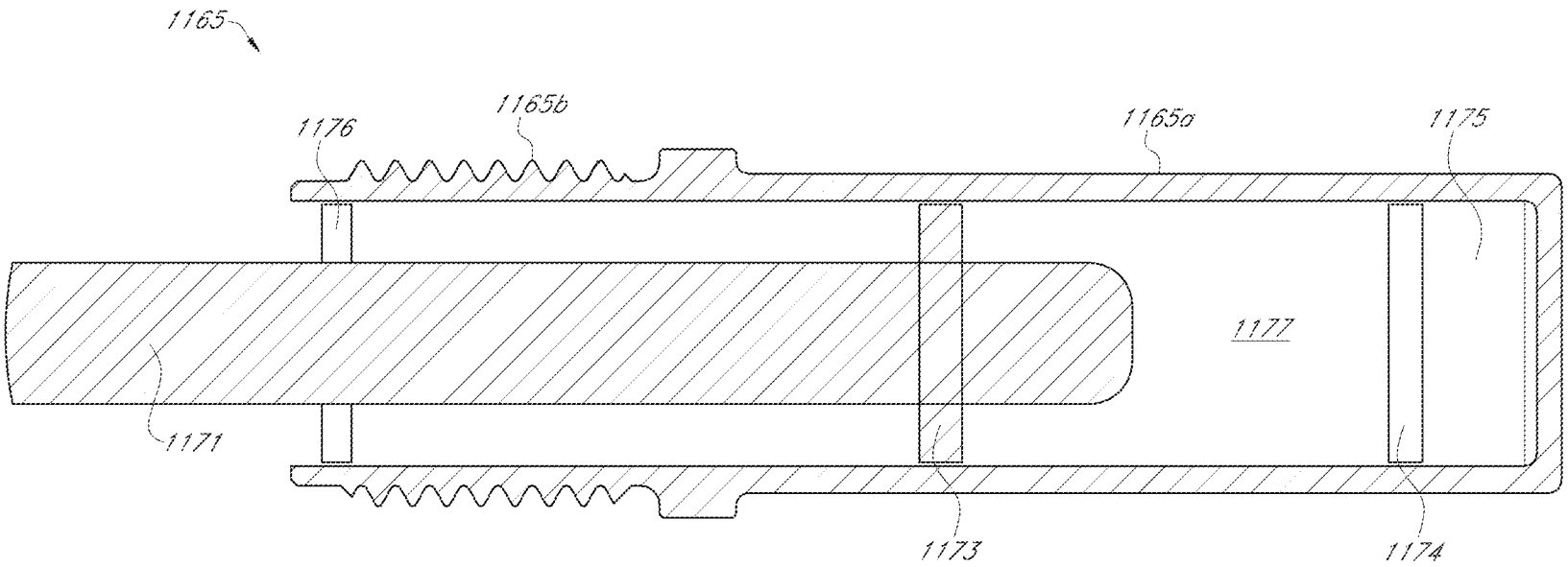
FIG. 16 shows an embodiment of a damper assembly.

FIG. 16 illustrates another embodiment of a plunger assembly 1165. The plunger assembly 1165 can be a dampening mechanism. The plunger assembly 1165 can be used with or without an additional spring such as the spring 1175. The plunger assembly 1165 can include a plunger 1171 The plunger assembly 1165 can include a housing 1165*a*. The housing 1165*a* can include a threaded region 1165*b*. The threaded region 1165*b* can be configured to connect with the base such as the base 1010 at the mounting portion 1167 described above. The housing 1165*a* can include a shaft seal 1176. The shaft seal 1176 and/or any other outer walls of the housing 1165 can enclose an internal space. The internal space can include an oil or liquid chamber 1177 and/or a gas or air chamber 1175. The liquid chamber 1177 can be separated from the gas chamber 1175 by a moveable plunger 1174.

The liquid chamber 1177 can be filled with an oil. The gas chamber 1175 can be filled with a gas such as compressed oxygen or nitrogen. The plunger 1171 can include a dampening gasket 1173. The dampening gasket 1173 can include one or more passageways there through for allowing the passage of liquid from one side of the gasket 1173 to the other. In certain implementations the direction of flow can be biased for passage of the liquid.

The plunger assembly 1165 can overall act as a damping mechanism. The plunger assembly 1165 can be used in the assembly of the truck 1000 above in place of the plunger assemblies 1065 and/or 1066. Accordingly, instead of providing a centering function, the plunger assemblies 1165 can provide damping for rotation of the hanger 1030 with respect to the base 1010. Similarly, the plunger 1171 can engage with the stem 1062. Thus, the velocity of the turns from a center position to a tilted or angled position can be dampened, depending on the rate of velocity change.

Figure 17:
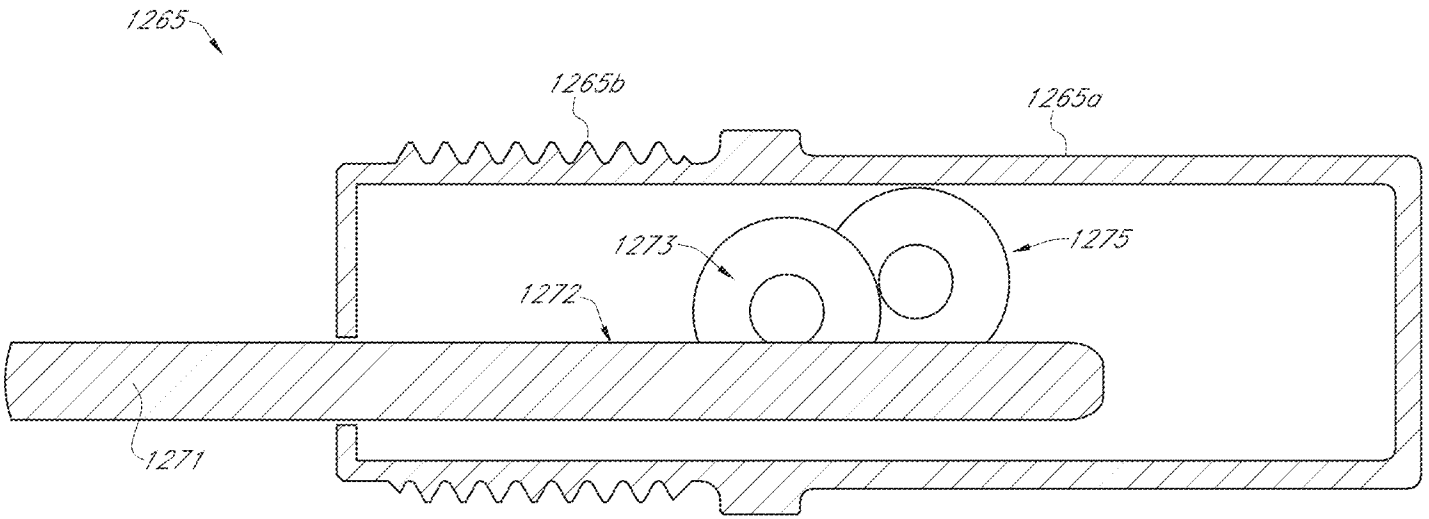
FIG. 17 shows an embodiment of a inerter assembly.

FIG. 17 illustrates another plunger assembly 1265. The assembly 1265 can be an inerter assembly. The plunger assembly 1265 can include a plunger 1271. The plunger assembly 1265 can include a housing 1265*a*. The housing 1265*a* can include a threaded portion 1265*b*. The plunger assembly 1265 can be used in the truck assembly 1000 above in place of the plunger assembly 1065 and/or 1066. The plunger assembly 1265 can include an inerter assembly therein. The inerter assembly can include a rack 1272 and a pinion 1273. The rack 1272 can be a portion of the plunger 1271 located within the housing 1265*a*. The rack 1272 can provide rotation to the pinion gear 1273 as the plunger 1271 is moved within the housing 1265*a*. The pinion gear 1273 can be coupled through gear teeth or other mechanism such as a belt with a fly wheel 1275. The fly wheel 1275 can store rotational energy from the pinion gear and the plunger 1271. Accordingly, the plunger assembly 1265 can act as an inerter for the rotation of the hanger 1030 with respect to the base 1010 in the assembly of the truck 1000.

Figure 18:
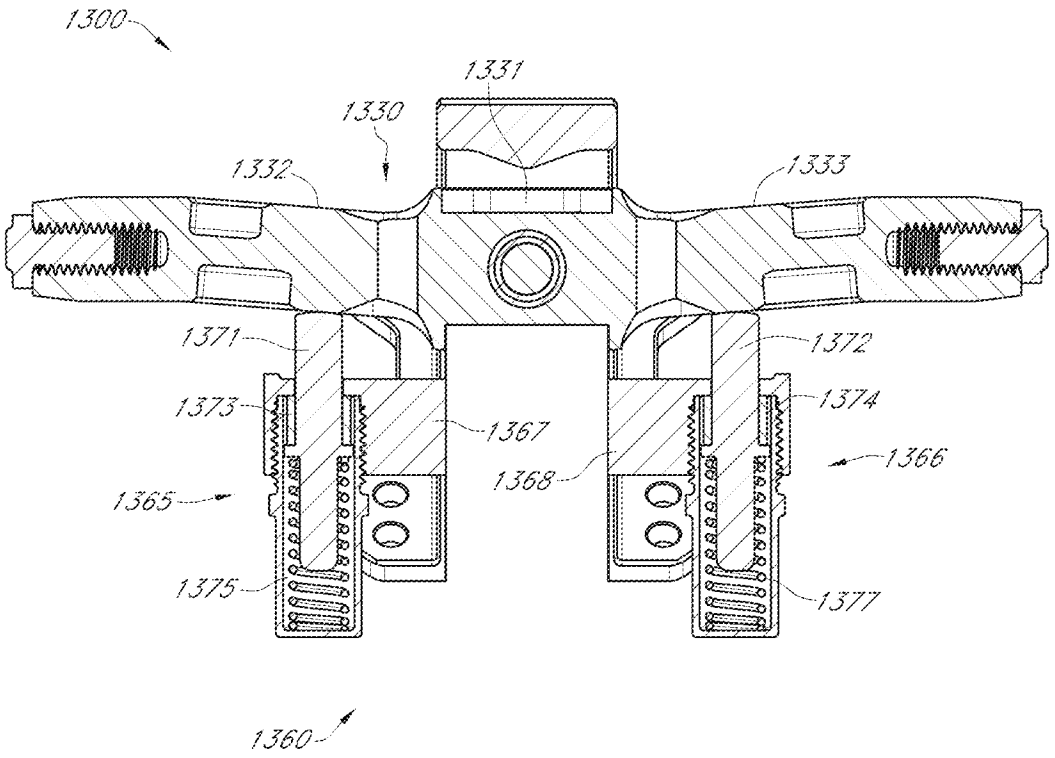
FIG. 18 shows another embodiment of a truck assembly.

FIG. 18 illustrates an alternative arrangement of a hanger 1300. The hanger 1300 can include a hanger 1330 pivotably coupled with a base 1310. The hanger 1330 can include a first wing 1332, a second wing 1333 and a center 1331. The base 1310 can include a centering mechanism 1360. The centering mechanism 1360 can include one or more plunger assemblies 1365, 1365, similar to the plunger assemblies described above. The base 1310 can include mount portions 1367, 1368 for mounting the respective plunger assemblies 1365, 1366. The plunger assemblies 1365, 1366 can include structures and/or functions as the plunger assembly 1065, 1165, 1265 described above. The plunger assembly 1365 can include a plunger 1371, a first spring 1373, and/or a second spring 1375. The plunger assembly 1365 can be oriented such that the plunger 1371 engages with a surface on the first wing 1332 to limit and/or control rotation of the hanger 1330 about an axis. The plunger assembly 1366 can include a plunger 1372, a first spring 1374, and/or a second spring 1377. The plunger assembly 1366 can be oriented such that the plunger 1372 engages with a surface on the second wing 1333 to limit and/or control rotation of the hanger 1330 about an axis.

Certain Terminology

Terms of orientation used herein, such as "upper," "lower," "front," "rear," "top," "bottom," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

SUMMARY

Several illustrative embodiments of trucks have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example assemblies. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices and systems may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of trucks have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

What is claimed is:

1. A truck comprising:

a base configured to couple with a deck and comprising a hanger aperture;

a hanger disposed within the hanger aperture of the base and pivotable about a pivot axis with respect to the base;

a centering mechanism, comprising:

a first plunger assembly coupled with a first mount portion of the base;

a first plunger having a first end and a second end, the first end engaged with the hanger and a second end disposed within a housing of the first plunger assembly; and a spring disposed within the housing of the first plunger to bias the first plunger into an extended position;

wherein in a first rotated position of the hanger relative to the base, the first plunger exerts a first rotation opposing force on the hanger.

2. The truck of claim 1, wherein the hanger includes a stem including a distal end and a proximal end, the proximal end extending from the hanger; the distal end of the stem engaged with the first end of the first plunger.

3. The truck of claim 2, further comprising:

a second plunger assembly coupled with a second mount portion of the base;

a second plunger having a first end and a second end, the first end engaged with the distal end of the stem and a second end disposed within a housing of the second plunger assembly;

a second spring disposed within the housing of the second plunger to bias the second plunger into an extended position;

wherein in a second rotated position of the hanger relative to the base, the second plunger exerts a second rotation opposing force on the stem;

wherein the first and second rotation opposing forces are configured to return the hanger into a centered position of the hanger relative to the base.

4. The truck of claim 2, wherein the first rotation opposing force exerted by the first plunger against the stem is a function of an angle of rotation of the hanger relative to the base.

5. The truck of claim 4, wherein a rate of increase of the first rotation opposing force is greater below a specified angle of rotation of the hanger relative to the base than the rate of increase of the first rotation opposing force above the specified angle.

6. The truck of claim 4, wherein a rate of increase of the first rotation opposing force is greater above a specified angle of rotation of the hanger relative to the base than a rate of increase of the first rotation opposing force below the specified angle.

7. The truck of claim 2, wherein the stem is rigidly connected with the hanger.

8. The truck of claim 2, wherein the distal end of the stem includes an opposing surface on a first side configured to contact and engage with the first plunger through a range of rotation angles of the hanger relative to the base.

9. The truck of claim 1, wherein the spring includes a plurality of sections, each section having a different spring constant.

10. The truck of claim 1, wherein the spring includes a plurality of springs contained within the housing of the first plunger assembly.

11. The truck of claim 1, wherein the housing of the first plunger assembly includes a first end portion having a threaded section and the first mount portion of the base includes a corresponding threaded section to assemble the housing with the base.

12. A truck comprising:

a base configured to couple with a deck and comprising a hanger aperture;

a hanger disposed within the hanger aperture of the base and pivotable about a pivot axis with respect to the base;

a centering mechanism, comprising:

a first plunger assembly coupled with a first mount portion of the base;

a first plunger having a first end and a second end, the first end engaged with the hanger and a second end disposed within a housing of the first plunger assembly; and wherein the first plunger assembly includes a damper.

13. A truck comprising:

a base configured to couple with a deck;

a hanger pivotably coupled with the base; and a resisting structure configured to provide an adjustable resisting force that exerts a torque on the hanger based on an angle of rotation of the hanger relative to the base, the adjustable resisting force configured to bias the hanger into a non-rotated position relative to the base;

wherein a rate of increase of the torque is greater below a specified angle than the rate of increase of the torque above the specified angle.

14. The truck of claim 13, further comprising a stem extending from the hanger.

15. The truck of claim 13, wherein the resisting structure is a plunger assembly on the base.

16. The truck of claim 13, wherein the torque is configured to center the hanger on the base.

17. The truck of claim 13, further comprising a compression assembly including first and second bushings.

18. A truck comprising:

a base configured to couple with a deck;

a hanger pivotably coupled with the base; and a resisting structure configured to provide an adjustable resisting force that exerts a torque on the hanger based on an angle of rotation of the hanger relative to the base, the adjustable resisting force configured to bias the hanger into a non-rotated position relative to the base;

wherein a rate of increase of the torque is greater above a specified angle than the rate of increase of the torque below the specified angle.

19. The truck of claim 18, wherein the resisting structure is a plunger assembly on the base.

20. A truck comprising:

a base configured to couple with a deck;

a hanger pivotably coupled with the base; and a resisting structure configured to provide an adjustable resisting force that exerts a torque on the hanger based on an angle of rotation of the hanger relative to the base, the adjustable resisting force configured to bias the hanger into a non-rotated position relative to the base;

wherein the resisting structure is a plunger assembly including a plunger and a spring, the spring engaged with the plunger to bias the plunger into an extended configuration; and wherein the spring is coupled with the base such that the plunger and the spring cause the torque on the hanger.

21. A truck comprising:

a base configured to couple with a deck and comprising a hanger aperture;

a hanger disposed within the hanger aperture of the base and pivotable about a pivot axis with respect to the base;

a centering mechanism, comprising:

a first plunger assembly coupled with a first mount portion of the base;

a first plunger having a first end and a second end, the first end engaged with the hanger and a second end disposed within a housing of the first plunger assembly; and wherein the first plunger assembly includes an inerter.

* * * * *